US006386926B1

(12) United States Patent
Lee

(10) Patent No.: US 6,386,926 B1
(45) Date of Patent: May 14, 2002

(54) SERIAL BUS CONNECTOR TERMINAL MAIN BODY

(76) Inventor: Su-Lan Yang Lee, 8th Floor, No. 506-2, Yuan-Shan Road, Chung Ho City, Taipei Hsien (TW)

( * ) Notice: Subject to any disclaimer, the term of this patent is extended or adjusted under 35 U.S.C. 154(b) by 0 days.

(21) Appl. No.: 09/883,287

(22) Filed: Jun. 19, 2001

(51) Int. Cl.[7] ..... H01R 13/405
(52) U.S. Cl. ..... 439/736; 439/492
(58) Field of Search ..... 439/736, 492, 439/494, 498, 499, 874

(56) References Cited

U.S. PATENT DOCUMENTS 4,579,404 A * 4/1986 Lockand ..... 439/736
6,004,160 A * 12/1999 Korsunstey et al. ..... 439/736
6,015,316 A * 1/2000 Matsubara ..... 439/736
6,200,171 B1 * 3/2001 Fusselman et al. ..... 439/736

* cited by examiner

*Primary Examiner*—Hien Vu
(74) *Attorney, Agent, or Firm*—Rosenberg, Klein & Lee

(57) ABSTRACT

Serial bus connector terminal main body including: a plastic main body having a central seat section, an electric connecting seat projecting from a first side of the central seat section and a lead connecting seat projecting from a second side thereof; multiple terminals, the front section of each terminal being defined as an electric connecting section lying on the electric connecting seat of the plastic main body, the rear section of each terminal being defined as a lead connecting section, the lead connecting sections being upward and downward interlacedly arranged on the upper and lower faces of the lead connecting seat of the main body; and at least one common terminal having a first electric connecting section. A lead connecting section extends from rear side of the first electric connecting section. A connecting plate is laterally interconnected between the front portion of the first electric connecting section and a second electric connecting section. The first and second electric connecting sections lie on the electric connecting seat of the main body. The connecting plate is projectively positioned above a sink of the electric connecting seat of the main body. The lead connecting section lies on the lead connecting seat of the main body.

1 Claim, 5 Drawing Sheets

SERIAL BUS CONNECTOR TERMINAL MAIN BODY

BACKGROUND OF THE INVENTION

The present invention is related to a serial bus connector terminal main body in which the lead connecting sections of multiple terminals upward and downward interlacedly lie on the upper and lower faces of the lead connecting seat of the plastic main body. A connecting plate is interconnected between a first and a second electric connecting sections of a common terminal and projectively positioned above a sink of the electric connecting seat of the plastic main body. The connecting plate can be easily punched off by a tool.

FIGS. 5, 6 and 7 show a conventional serial bus connector terminal main body. Multiple terminals 42 are side by side inlaid in the plastic main body 41 on the same plane. A connecting plate 43 is connected between two adjacent terminals 42. When tested, the connecting plate 43 is punched off by a tool. The above conventional terminal main body has some shortcomings in manufacturing as follows:

1. As shown in FIGS. 5, 6 and 7, the terminals 42 are side by side inlaid in the plastic main body 41 on the same plane. The connector has a quite small volume so that the clearance between two adjacent terminals 42 is very small and it is hard to perform soldering operation. When an operator solders leads L on the terminals 42, the solder 40 tends to spill to interconnect the adjacent terminals 42. This will lead to short circuit and reduce the ratio of good products.
2. The connecting plate 43 is positioned in a sink 44 of the central seat body of the main body 41 for connecting the two adjacent terminals 42. The sink 44 is very small so that it is hard to perform the punching operation. Moreover, after punched, it is hard for the operator to visually identify whether the connecting plate 43 has been truly punched off.

SUMMARY OF THE INVENTION

It is therefore a primary object of the present invention to provide a serial bus connector terminal main body including: a plastic main body including a central seat section, an electric connecting seat projecting from a first side of the central seat section, an upper face of the electric connecting seat being side by side formed with multiple receiving channels, a lead connecting seat projecting from a second side of the central seat section, the lead connecting seat being formed with a central partitioning board, an upper and a lower faces of the central partitioning board being respectively formed with multiple lead channels, whereby a stop wall is defined between each two adjacent lead channels of the upper and lower faces; multiple terminals, a front section of each terminal being defined as an electric connecting section, a rear section of each terminal being defined as a lead connecting section, the electric connecting section of each terminal lying on one receiving channel of the electric connecting seat of the main body, the lead connecting section of each terminal lying on a lead channel of the lead connecting seat of the main body; and at least one common terminal having a first electric connecting section, a lead connecting section extending from rear side of the common terminal of the first electric connecting section, a connecting plate being laterally interconnected between the front portion of the first electric connecting section and a second electric connecting section, the first and second electric connecting sections respectively lying on one receiving channel of the electric connecting seat of the main body, the connecting plate being projectively positioned above a sink of the electric connecting seat of the main body. When testing the signal, the connecting plate can be easily punched off by a tool. The lead connecting sections of the common terminal and the lead connecting sections of the respective terminals are sequentially inlaid in multiple lead channels of the main body.

The present invention can be best understood through the following description and accompanying drawings wherein:

DETAILED DESCRIPTION OF THE PREFERRED EMBODIMENT

Figure 1:
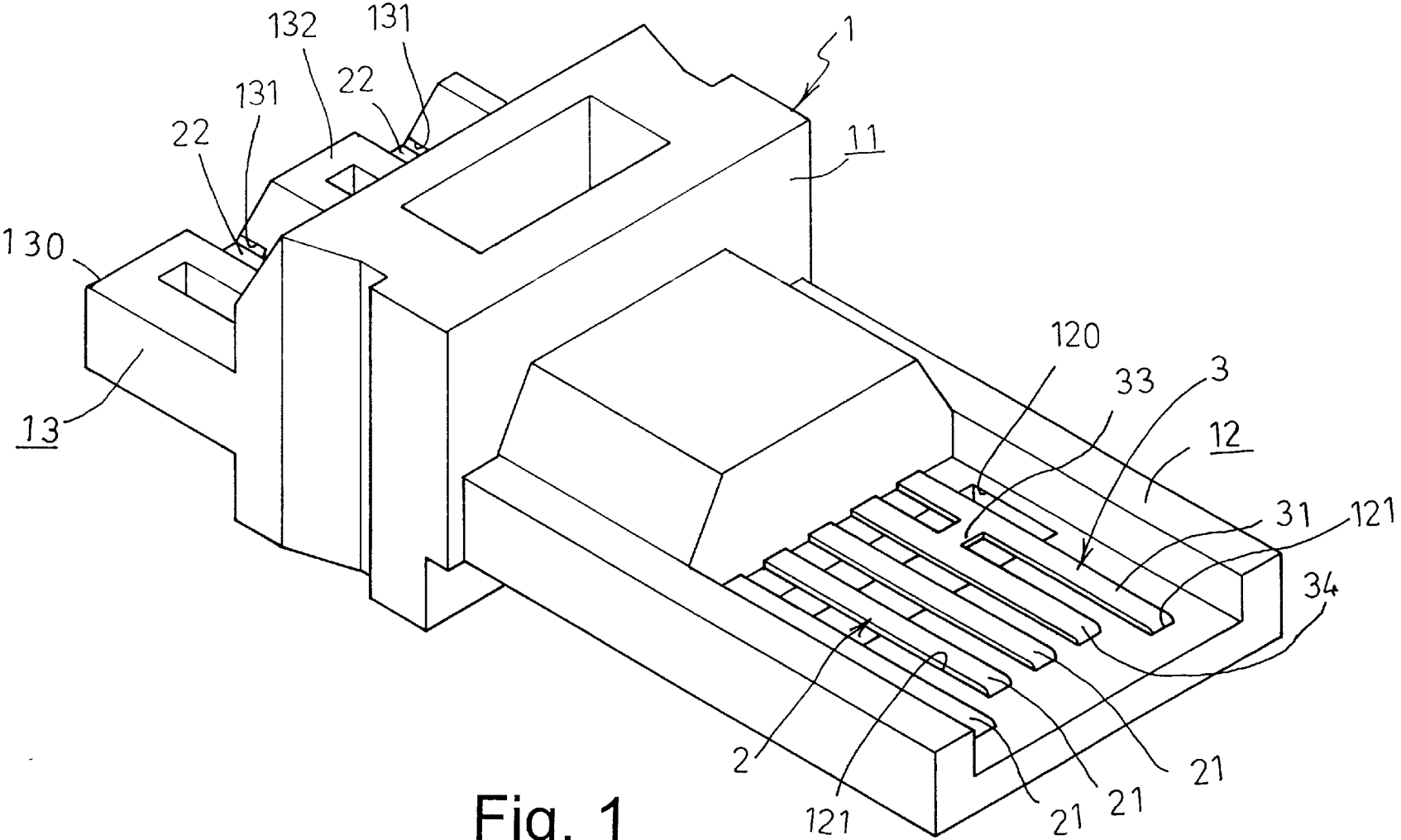
FIG. 1 is a front perspective view of the present invention.
Figure 2:
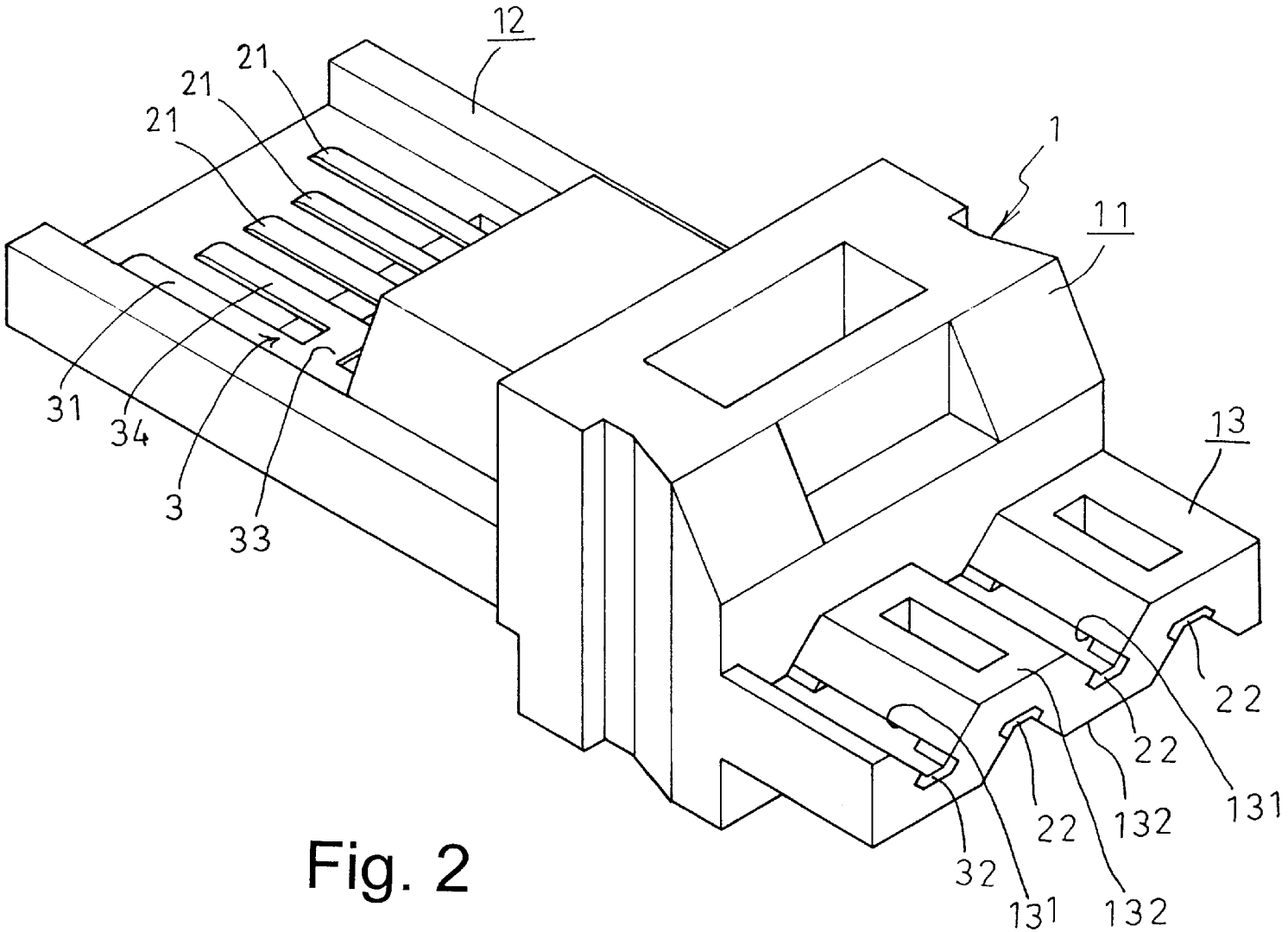
FIG. 2 is a rear perspective view of the present invention.

Please refer to FIGS. 1 to 4. The serial bus connector terminal main body of the present invention include a plastic main body 1 having a central seat section 11. An electric connecting seat 12 projects from a first side of the central seat section 11 and a lead connecting seat 13 projects from a second side thereof. The present invention further includes multiple terminals 2. The front section of each terminal 2 is defined as an electric connecting section 21 lying on the electric connecting seat 12 of the plastic main body 1. The rear section of each terminal 2 is defined as a lead connecting section 22. The lead connecting sections 22 are upward and downward interlacedly arranged on the upper and lower faces of the lead connecting seat 13 of the main body 1. The present invention further includes at least one common terminal 3 having a first electric connecting section 31. A lead connecting section 32 extends from rear side of the first electric connecting section 31. A connecting plate 33 is laterally interconnected between the front portion of the first electric connecting section 31 and a second electric connecting section 34. The first and second electric connecting sections 31, 34 lie on the electric connecting seat 12 of the main body 1. The connecting plate 33 is projectively positioned above a sink 120 of the electric connecting seat 12 of the main body 1. The lead connecting section 32 lies on the lead connecting seat 13 of the main body 1. The lead connecting section 32 and the lead connecting sections 22 of the terminals 2 are sequentially inlaid in multiple lead channels 131 formed on the upper and lower faces of a central partitioning board 130 of the lead connecting seat 13.

Referring to FIGS. 1 to 4, the plastic main body 1 includes a central seat section 11. The electric connecting seat 12 projects from a first side of the central seat section. The upper face of the electric connecting seat 12 is side by side formed with multiple receiving channels 121. The lead connecting seat 13 projects from a second side of the central seat section 11. The lead connecting seat 13 is formed with a central partitioning board 130. The upper and lower faces of the central partitioning board 130 are respectively formed with multiple lead channels 131. A stop wall 132 is defined between each two adjacent lead channels 131.

The front section of each terminal 2 is defined as an electric connecting section 21. The rear section of each terminal 2 is defined as a lead connecting section 22. When molding the plastic main body 1, the terminals 2 are previously placed in the mold. After injection molding the main body 1, the electric connecting section 21 of the terminal 2 lies on and is inlaid in a receiving channel 121 of the main body 1. The lead connecting section 22 of the terminal 2 lies on and is inlaid in a lead channel 131 of the main body 1.

Figure 3:
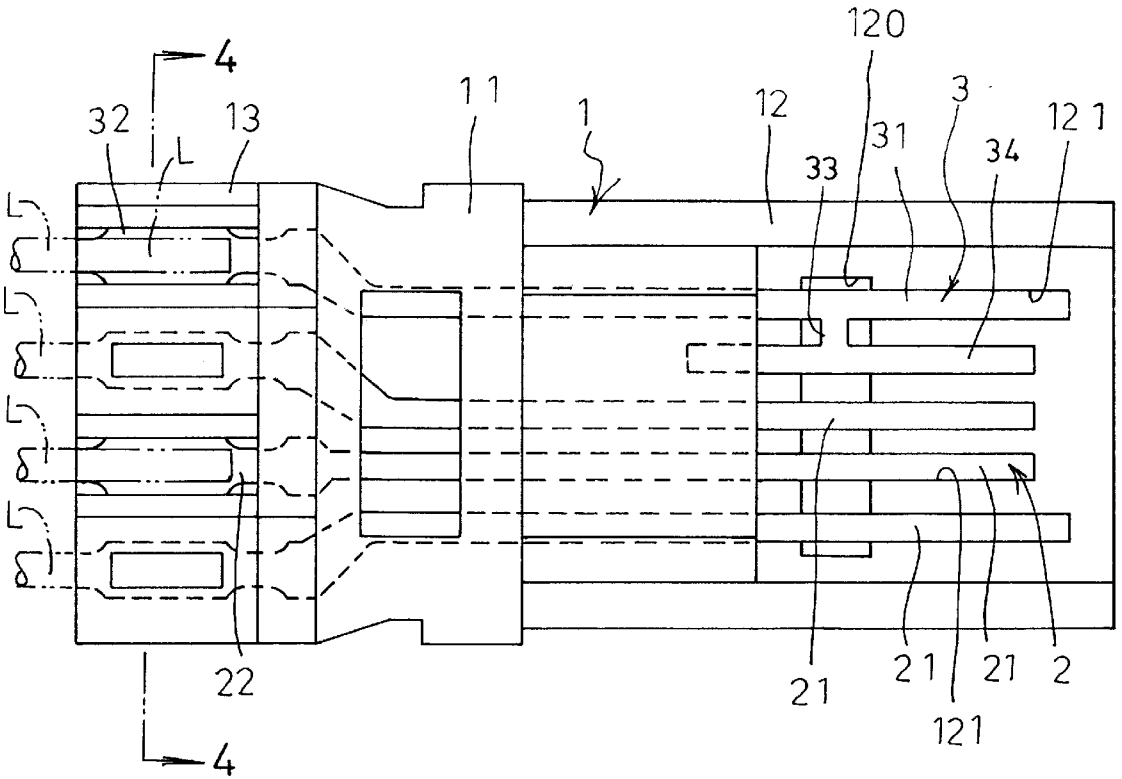
FIG. 3 is a top view of the present invention.
Figure 4:
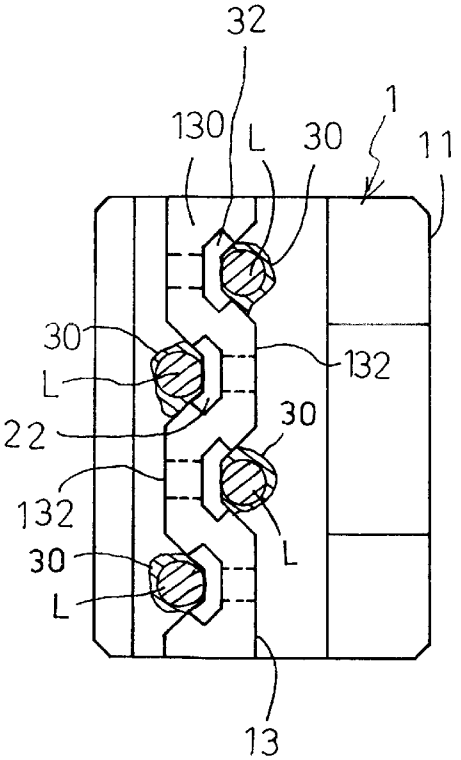
FIG. 4 is a sectional view taken along line 4—4 of FIG. 3, showing that the leads are soldered on the terminals.
Figure 5:
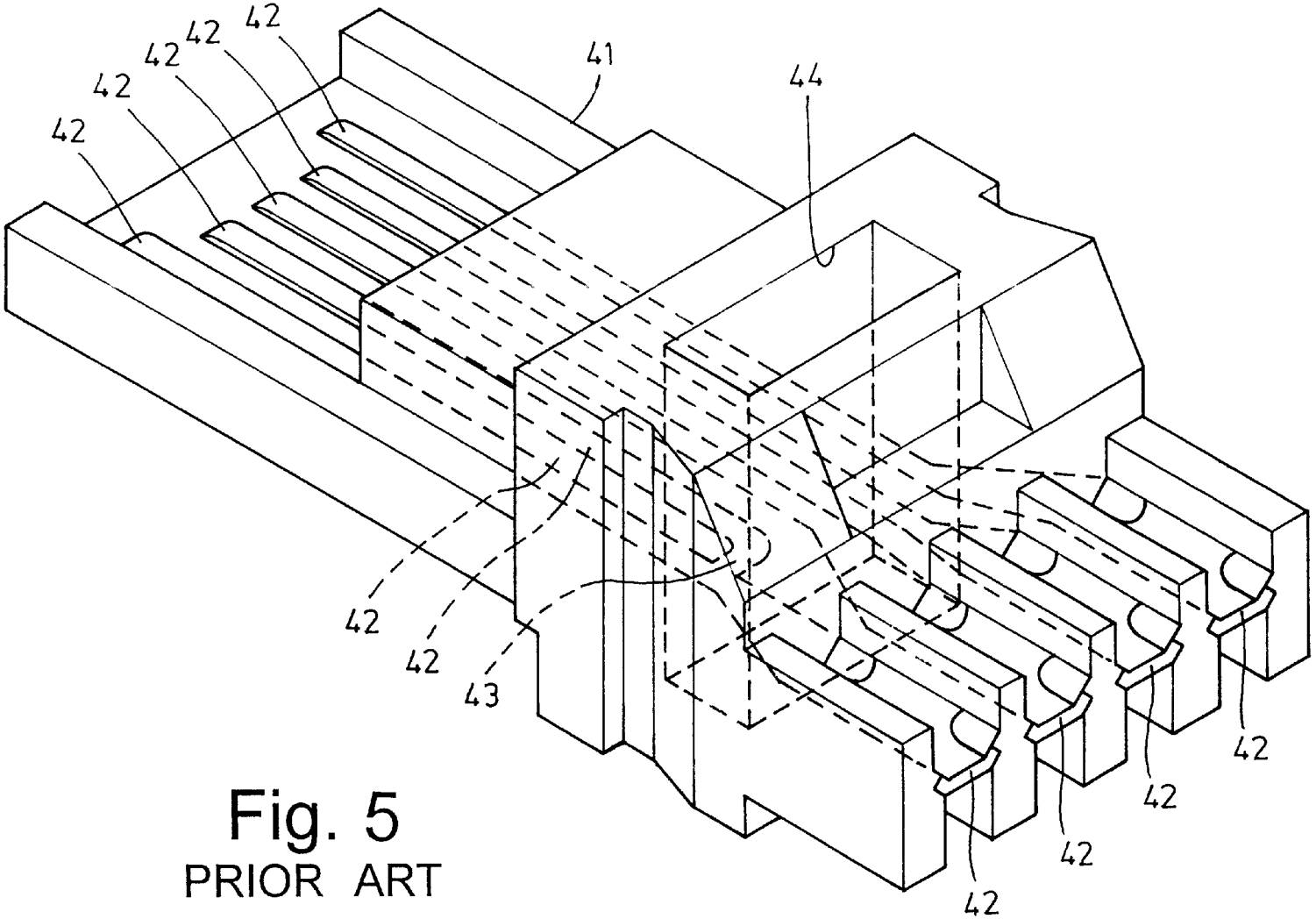
Fig. 5 PRIOR ART
FIG. 5 is a perspective view of a conventional terminal main body.
Figure 6:
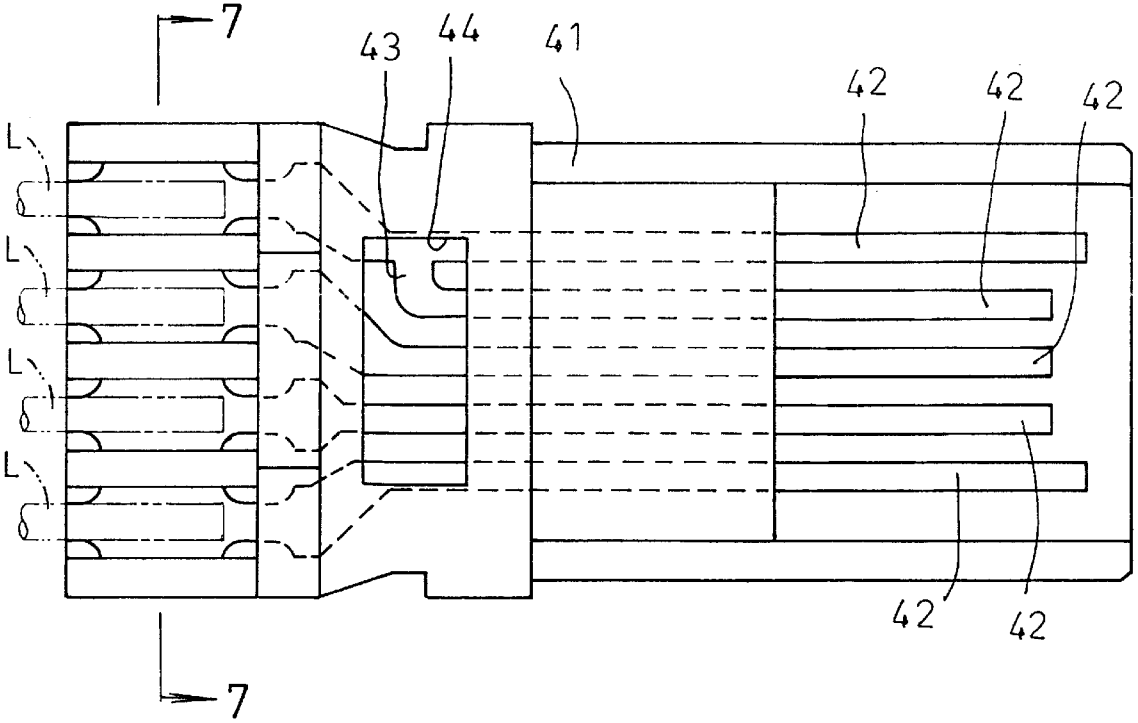
Fig. 6 PRIOR ART
FIG. 6 is a top view of the conventional terminal main body.
Figure 7:
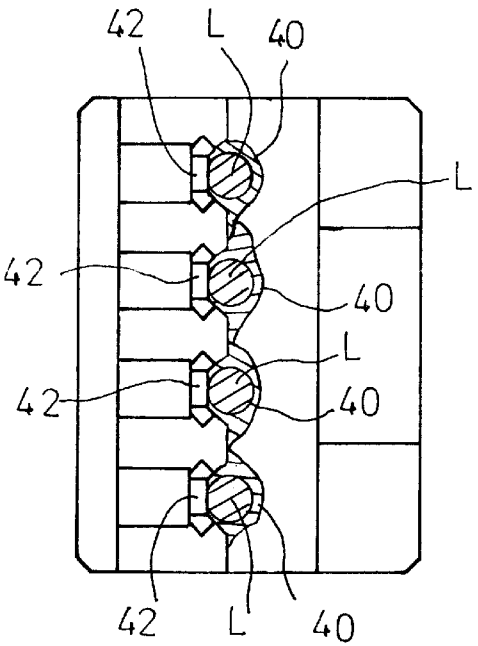
Fig. 7 PRIOR ART
FIG. 7 is a sectional view taken along line 7—7 of FIG. 6, showing that the leads are soldered on the terminals.

Referring to FIGS. 3 and 4, the lead connecting sections 22, 32 of the terminals 2 and the common terminal 3 are upward and downward interlacedly arranged on and lie on lead channels 131 of the upper and lower faces of the central partitioning board 130 of the lead connecting seat 13 of the main body 1. Accordingly, the clearance between two adjacent lead connecting sections 22 or between the lead connecting section 22 and the lead connecting section 32 arranged on the same face of the central partitioning board 130 is widened. A stop wall 132 is naturally defined between the two lead connecting sections 22, 32. Therefore, when soldering the lead L on the lead connecting sections 22 of the terminal 2 and the lead connecting section 32 of the common terminal 3, the enlarged clearance facilitates soldering operation. In addition, the possibility of short circuit caused by that the solder 30 spills to interconnect the adjacent terminals can be minimized.

In the common terminal 3, the connecting plate 33 between the first and second electric connecting sections 31, 34 lies on the electric connecting seat 12 which is exposed to outer side. Therefore, the punching operation can be more easily performed and the operator can more easily identify whether the punching operation has been truly performed. Therefore, the ratio of defective products is reduced.

The above embodiment is only used to illustrate the present invention, not intended to limit the scope thereof. Many modifications of the above embodiment can be made without departing from the spirit of the present invention.

What is claimed is:

1. Serial bus connector terminal main body comprising:

a plastic main body including a central seat section, an electric connecting seat projecting from a first side of the central seat section, an upper face of the electric connecting seat being side by side formed with multiple receiving channels, a lead connecting seat projecting from a second side of the central seat section, the lead connecting seat being formed with a central partitioning board, an upper and a lower face of the central partitioning board being respectively formed with multiple lead channels, whereby a stop wall is defined between each two adjacent lead channels of the upper and lower faces;

multiple terminals, a front section of each terminal being defined as an electric connecting section, a rear section of each terminal being defined as a lead connecting section, the electric connecting section of each terminal lying on one receiving channel of the electric connecting seat of the main body, the lead connecting section of each terminal lying on a lead channel of the lead connecting seat of the main body; and at least one common terminal having a first electric connecting section, a lead connecting section extending from rear side of the common terminal of the first electric connecting section, a connecting plate being laterally interconnected between the front portion of the first electric connecting section and a second electric connecting section, the first and second electric connecting sections respectively lying on one receiving channel of the electric connecting seat of the main body, the connecting plate being projectively positioned above a sink of the electric connecting seat of the main body, the lead connecting section lying on the lead connecting seat of the main body, the lead connecting sections of the common terminal and the lead connecting sections of the respective terminals being sequentially inlaid inmultiple lead channels formed on the upper and lower faces of the central partitioning board of the main body.

* * * * *